US005557302A

United States Patent [19]

Levinthal et al.

[11] Patent Number: 5,557,302

[45] Date of Patent: Sep. 17, 1996

[54] METHOD AND APPARATUS FOR DISPLAYING VIDEO DATA ON A COMPUTER DISPLAY

[75] Inventors: Adam Levinthal, Redwood City; Ross Werner, Woodside; J. Lane Molpus, Larkspur, all of Calif.

[73] Assignee: NeXT, Inc., Redwood City, Calif.

[21] Appl. No.: 434,654

[22] Filed: May 4, 1995

Related U.S. Application Data

[63] Continuation of Ser. No. 272,908, Jul. 8, 1994, which is a continuation of Ser. No. 4,637, Jan. 12, 1993, which is a continuation of Ser. No. 580,275, Sep. 10, 1990.

[51] Int. Cl.[6] ..... G09G 5/36

[52] U.S. Cl. ..... 345/189; 345/191; 345/115

[58] Field of Search ..... 345/115, 119, 345/120, 189, 191; 395/157

[56] References Cited

U.S. PATENT DOCUMENTS

| | | | |
|---|---|---|---|
| 4,148,070 | 4/1979 | Taylor | 358/160 |
| 4,417,276 | 11/1983 | Bennett et al. | 358/138 |
| 4,599,611 | 7/1986 | Bowker et al. | 340/745 |
| 4,750,039 | 6/1988 | Willis | 358/22 PIP |
| 4,769,762 | 9/1988 | Tsujido | 340/721 |
| 4,829,455 | 5/1989 | Long et al. | 340/723 |
| 4,947,257 | 8/1990 | Fernandez et al. | 340/723 |
| 4,999,715 | 3/1991 | Porcellio et al. | 358/444 |

*Primary Examiner*—Richard Hjerpe
*Assistant Examiner*—Matthew Luu
*Attorney, Agent, or Firm*—Fitzpatrick, Cella, Harper & Scinto

[57] ABSTRACT

A method and apparatus for displaying video data on a computer display. Video data is digitized at a video rate and displayed at a different (higher) rate. The digitized video data is provided to the computer memory along with the computer-generated display data. Thus, the video data is part of the windowing environment and can be manipulated like any other window on the display screen. The video data can be arbitrarily sized and is not limited by the input format. The video input is provided to the computer system as a video stream. Next, the video data is resampled and converted from, e.g., the NTSC standard 640×480 array into an N×M array where N is less than or equal to 640, and M is less than or equal to 480. The video data is then selectively stored in the computer memory with the computer display data by referencing a bit map in the computer memory, producing a region of pixel data that is fully compatible with other windows in the windowing environment.

20 Claims, 7 Drawing Sheets

METHOD AND APPARATUS FOR DISPLAYING VIDEO DATA ON A COMPUTER DISPLAY

This application is a continuation of application Ser. No. 08/004,637 filed Jan. 12, 1993, now abandoned, which was a continuation of application Ser. No. 07/580,275 filed Sep. 10, 1990, now abandoned.

BACKGROUND OF THE INVENTION

1. Field of the Invention

This invention relates to the field of computer displays and in particular, to a method and apparatus for displaying video data, such as from a television transmission, video tape player, video disc, etc., on a computer display.

2. Background Art

Many personal computers and workstations provide an environment in which one or more computer programs may be displayed in a graphical user interface that provides a multi-window display. A computer program may generate graphical and text display data in selected windows on the display. However, it is also desirable to be able to display information from other sources within windows, such as from video data sources.

In the prior art, video data is processed separately from other computer display data. Computer display data is generated and provided to the display on a first path. A second path is provided for accepting video data from a video source such as a television transmission, video tape player, video disc, etc. The video data is merged with computer display data at a summing node for eventual display on a computer display.

In such prior art schemes, the video data is processed outside the windowing environment that is associated with the interaction, presentation and manipulation of computer display data shown as application program output data. Such data, therefore, cannot be manipulated, resized, moved, etc. within an associated window like computer display data. In addition, video data may not be buffered, in which case it must be displayed at the video data rate, which is typically different than the computer display rate, degrading resolution.

One prior art video processing system is described in Taylor, U.S. Pat. No. 4,148,070. Taylor is directed to a video processing system that uses an analog to digital converter to receive a video signal and convert the signal into a digital form. The digital data is stored in a digital frame store buffer. Addressing means address locations within the frame store to access data. A digital to analog converter receives the data from the frame store and converts the data into analog output for display. The video display circuitry is separate from the computer display circuitry. The system of Taylor is limited to a certain display size and the size of the display cannot be modified. In addition, Taylor is not directed to a computer system that utilizes a windowing environment.

Another prior art system is described in Bennett, et al., U.S. Pat. No. 4,417,276. In Bennett means are provided for continuous digitization of successive video images for storage in computer memory. Compression schemes are included to produce a spatially compressed image to reduce memory requirements. The system of Bennett is a dedicated system for digitizing video data and displaying video data. As such, there is no discussion in Bennett of windows capable of manipulation or of merging video data with non-video computer display data.

Fukushima, et al., U.S. Pat. No. 4,498,081 is directed to a display device for displaying both video and graphic or character images. Fukushima provides a separate video data memory for video information and a separate graphic data memory for graphic information. The outputs of these memories are combined and provided to a display. Fukushima, however, is not directed to the presentation of video data in windows.

An interlace/non-interlace converter is described in Bloom, U.S. Pat. No. 4,698,674. The data converter of Bloom converts interlace formatted data into a non-interlace format for storage and memory. Converter circuitry is coupled between the video data source and the memory associated with a CPU that controls the generation of memory addresses to store the data in interlaced or non-interlaced format. The device permits interlaced or non-interlaced data to be manipulated for eventual display. The device of Bloom provides output to a full screen. Bloom also does not show or teach presentation of video data within windows, or combining of video with computer display data.

It is an object of the present invention to provide a method and apparatus for displaying video data on a computer display in connection with computer display data in a windowing environment.

It is a further object of the present invention to provide a method and apparatus for receiving video data at a video rate and displaying it at a different rate.

SUMMARY OF THE INVENTION

The present invention is directed to a method and apparatus for displaying video data and computer display data on a computer display. This invention provides an interface between a computer system windowing environment and a video data source. Analog video data is provided to the interface at a video rate and converted to digital pixels for display at a different pixel rate. The digitized video data is provided to a standard computer memory for display on a high resolution display, along with computer display data. Thus, the video data is then selectively stored in the memory with computer display data by referencing a bit map in the memory, providing a region of pixel data that is fully compatible with other windows in the windowing environment. The video data can be arbitrarily sized and is not limited by the input format.

The video data is resampled and converted from the, e.g., NTSC standard 640×480 array, into an N×M array where N is less than or equal to 640, and M is less than or equal to 480. The video data is then sized to the window boundary (which can be arbitrary), masked to account for occluding windows, and stored in a frame buffer with the computer display data. The video data may be received in interlaced or non-interlaced format. If interlaced, the video data is assembled for storage in a non-interlaced format.

DETAILED DESCRIPTION OF THE INVENTION

A method and apparatus for displaying video data on a computer display is described. In the following description, numerous specific details, such as data rate, display format, etc., are set forth in detail in order to provide a more thorough description of the invention. It will be apparent, however, to one skilled in the art, that the present invention can be practiced without these specific details. In other instances, well known features have not been described in detail so as not to unnecessarily obscure the present invention.

PRIOR ART

Figure 1:
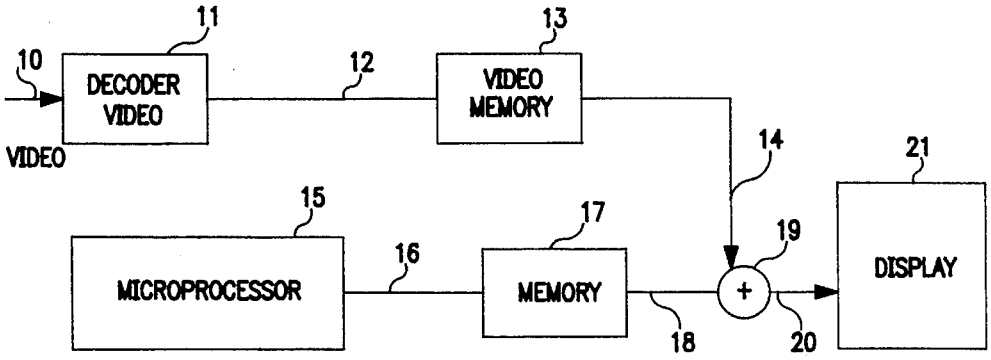
FIG. 1 is a block diagram of a prior art system for displaying video data on a computer display.

A block diagram of a prior art system for displaying video data on a computer display is illustrated in FIG. 1. A microprocessor 15 generates text and/or graphic information for display on a computer display 21. The microprocessor 15 provides this computer display data on line 16 to a memory 17. Memory 17 may be a frame buffer or other display memory. Video data 10 is provided to a decoder 11 for conversion from analog to digital format. The decoder 11 provides digitized video output on line 12 to video memory 13. The video memory 13 provides the digitized video as output on line 14 to summing node 19 where it is combined with the output of frame buffer 17. The output 20 of summing node 19 is provided to display 21 for display.

A disadvantage of some prior art systems, such as the prior art system described in FIG. 1, is that the display rate is limited by the video data rate. Generally, NTSC video is broadcast at a pixel rate of about 12.75 MHz. By contrast, high resolution computer display data is provided to a computer display at typically 100 MHz. By limiting the computer display to the video rate, resolution of the computer display data is degraded. Another disadvantage of the prior art system of FIG. 1 is the use of separate memories for digitized video data and computer display data. Because the video data is in a separate memory, it is not a part of the windowing system and therefore a window displaying video data cannot be manipulated, moved or resized as can windows containing computer display data. Also, prior art systems require that the video data be the "topmost" display information. That is, the video data may not be overlapped by other windows.

THE PRESENT INVENTION

This invention provides a method for converting a video stream, that is a sequence of video pixels, into an arbitrary array of pixels. This arbitrary array of pixels can then be stored in computer memory and displayed along with other computer display data in arbitrarily sized and positioned windows. In addition, individual still frames of video can be displayed in multiple windows. Alternatively, video data can be stored in non-visible portions of the computer memory. When displayed in a window, the video data may be overlapped by other windows. In other words, the video window need not be the topmost window.

Figure 2:
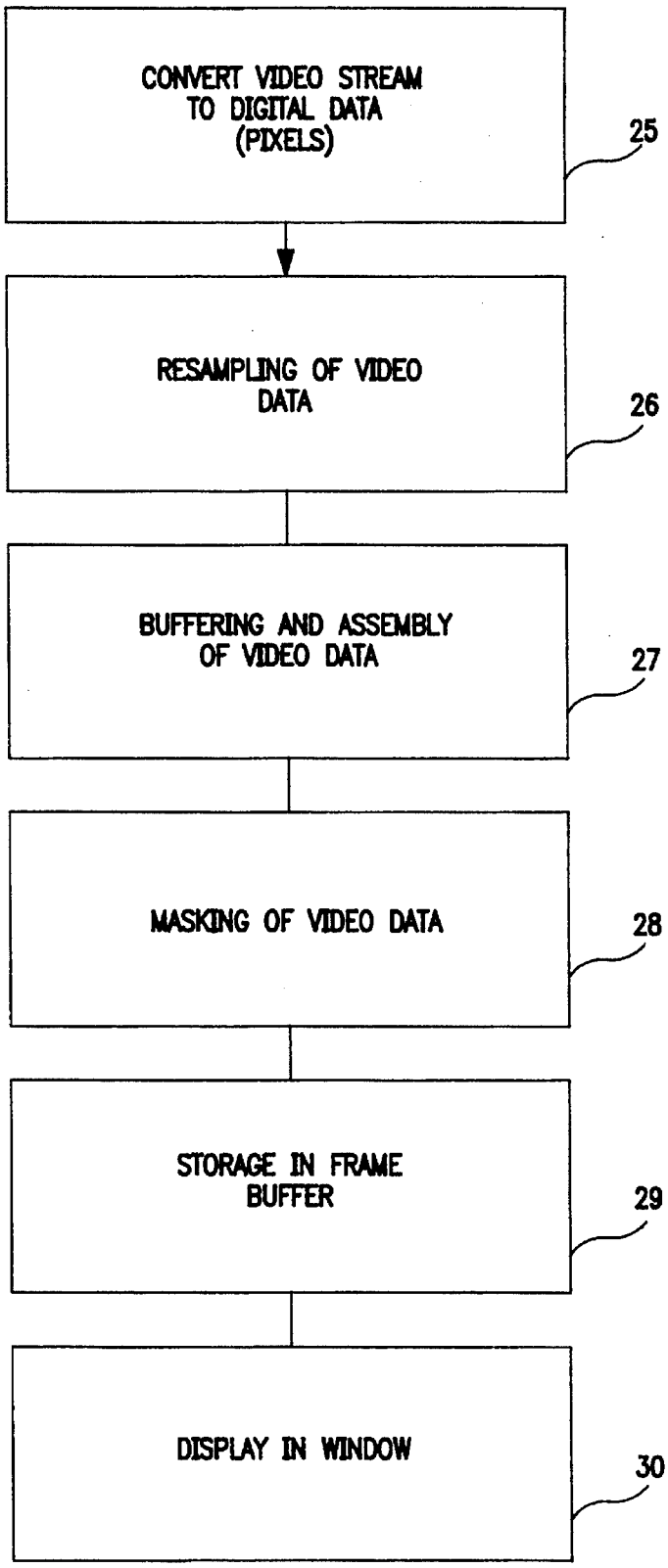
FIG. 2 is a flow diagram illustrating the operation of the present invention.

A flow diagram illustrating the sequence of operations of this invention is illustrated in FIG. 2. At step 25 of FIG. 2, the analog video input signal is received and converted into a stream of digital data, (i.e., pixels). This is accomplished by coupling the video data stream to an analog to digital converter, providing digital output.

In this invention, the source of video data may be a television transmission, a video tape or other source of live (e.g., a camera) or previously stored video data. Typically, the video data is encoded to comply with the National Television System Committee (NTSC) standard. However, other video formats, such as phase alternating line (PAL), can also be utilized in this invention. In the NTSC standard, a quadrature amplitude modulation (QAM) signal is transmitted, having a luminance value Y and chrominance values U and V (or YIQ values). The video input signal is demodulated and converted to digitized Y, U and V values. The digital YUV values are provided to a YUV-to-RGB (red, green, blue) matrix and converted to RGB pixels.

In the present invention, 24 digital bits are generated for each video pixel. These 24 bits include 8 bits each for the red, green and blue components of the video pixel. The use of 24 bits per pixel is not required to practice this invention, and is set forth by way of example only.

At step 26, the video data is "resampled" into a desired size. In the United States, for example, video data is transmitted in an array of 640 pixels ×480 pixels. In this invention, the video data is resampled into a rectangle N×M where N is less than or equal to 640 and M is less than or equal to 480. The present invention uses a filtering technique to convert the input data rectangle to a desired rectangle. An example of this technique is known as "edge table".

The edge table filtering is accomplished with two bit masks. A first bit mask contains a bit entry for each pixel in a video line. A second bit mask contains a bit entry for each line of video. In one embodiment of this invention, each bit mask includes 1024 bits to accommodate video formats up to 1024×1024. The size of the bit mask and video format may be any suitable size. Each input pixel is passed through the edge tables. If the corresponding pixel and line locations of the input pixel are enabled, that pixel is passed through to memory. If not, the pixel is not passed. The step of resampling the video data is not required, and the present invention can be practiced without this step.

The analog to digital conversion occurs serially and produces a digital serial stream output. This serial stream is generated at a pixel rate matching the pixel rate of the television transmission. This invention buffers the serial pixel stream at step 27 to achieve rate matching with the computer display. To accomplish this rate matching, the serial stream is converted to packet bursts prior to subsequent operations. A packet burst in the preferred embodiment of this invention consists of 64 pixels.

The serial stream is provided to two buffers, each 64×24 bits in the preferred embodiment of this invention. One buffer is filled front the serial stream while the other is being emptied and then the buffers are switched. The input pixel rate is lower than the rate at which the buffers can be emptied. Therefore, the buffers are emptied in bursts, as opposed to a steady rate. This buffering scheme permits storing the video information in the computer memory, which may be displayed at a much higher rate than the video rate, allowing greater resolution to be achieved on the computer display. It also results in greater availability of bus time for other devices (e.g., a microprocessor) to manipulate the data in the computer memory.

Video input data may be received in an interlaced or non-interlaced format. In an interlaced format, one field consists of all the even-numbered scan lines and the next field consists of the odd-numbered scan lines of the image. Thus the odd and even scan lines are alternately projected onto a display screen. The persistence of the eye is such that the image jump and blur of the displayed image is generally not affected by the interlacing. In this invention, interlaced scan lines are "assembled", that is, converted to non-interlaced format. This is accomplished by writing the even field into even-numbered lines in the computer memory video window, and the odd field into odd-numbered lines in the video window. Whether a line is odd or even is determined relative to the to of the window and not the display. For non-interlaced video, each line of each frame is written sequentially into the video window in the computer memory.

After buffering, the video data is masked at step 28. For a given window, only certain ("valid") of the pixels might be displayed. Therefore, only valid pixels need to be stored in this invention. Mask circuitry is provided to identify the valid pixels. Masking refers to identifying those pixels that are valid (i.e., not occluded by other windows or otherwise not required by the windowing system) in the video window boundary. At step 29, the resampled and masked video data is stored in a computer memory, access to which is shared with other devices, (e.g., a microprocessor) that manipulate computer display data. The computer memory contains all the visible portions of the various windows, including the video window. Part of the computer memory, the display memory, is read and displayed. At step 30, the display memory data, composed of the visible areas of the various windows, is displayed on a computer display. The mask permits video input at real-time rate to correctly interact with the other windows on the display. The mask itself resides in the same computer memory as pixels and other data associated with the window system. With multiple overlapping windows, the visible portion of the video window may be a complex assembly of non-contiguous rectangles. The use of the mask simplifies the task of identifying such valid pixels.

The video data is stored in the computer memory along with other computer display data and is treated as ordinary pixel data. It can be manipulated and changed by a control microprocessor and manipulated in the windowing environment as desired. The contents of the display memory are provided to screen drivers to provide an output display of the images stored in the display memory.

Figure 3:
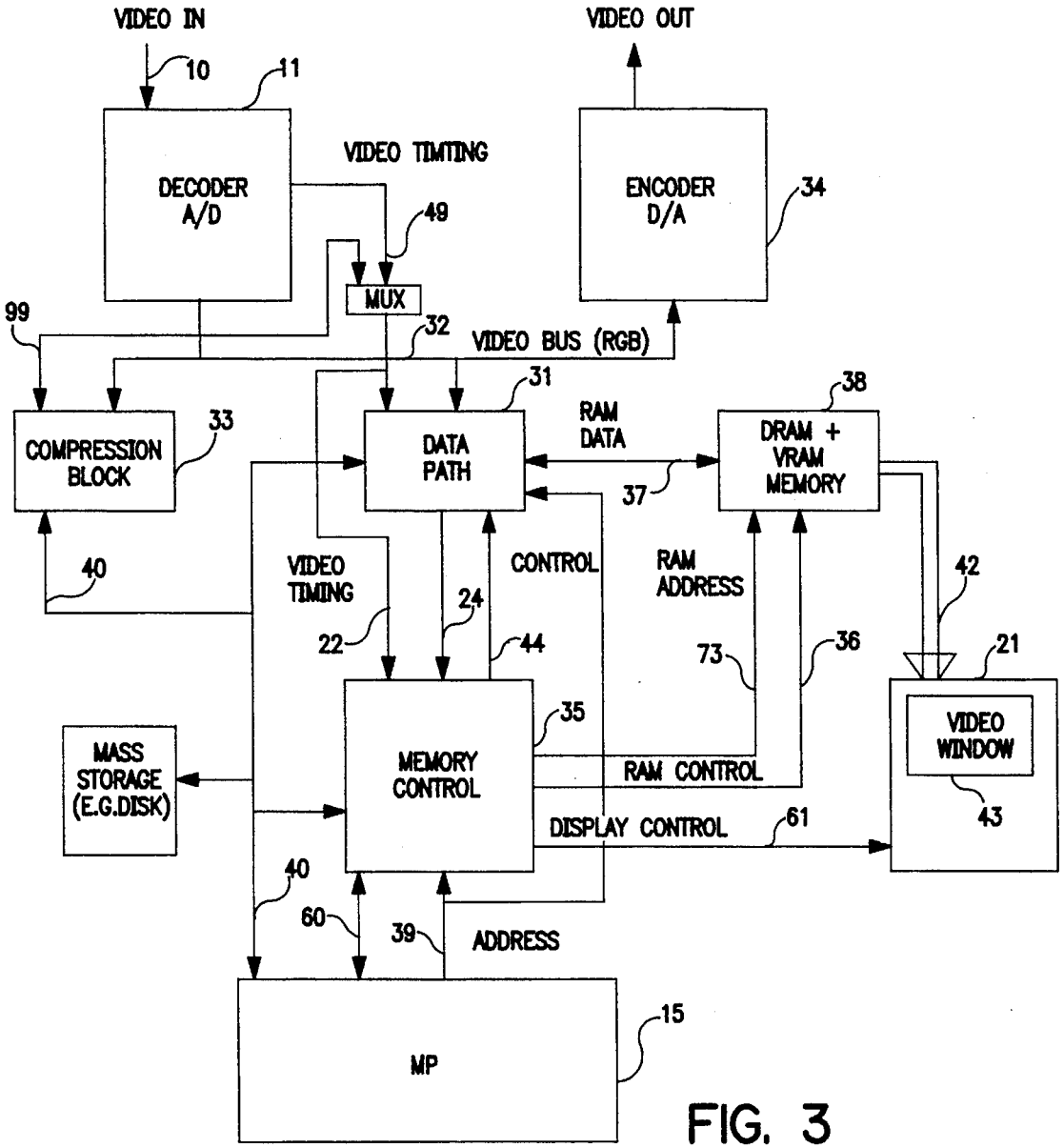
FIG. 3 is a block diagram illustrating the preferred embodiment of the present invention.

A block diagram of the preferred embodiment of this invention is illustrated in FIG. 3. Video input 10 from a source such as a live television transmission, VCR playback, etc., is provided to decoder 11 for conversion from analog to digital RGB format. The converted video data is provided as output on video bus 32 and provided to a compression block 33, data path 31 and encoder 34. Video timing information is provided on line 22 (by the video decoder) or 99 (by the compression block) to data path block 31 and memory control block 35.

A microprocessor 15 provides/reads computer display data to/from data path block 31, memory control block 35 and compression block 33 on data bus 40. The microprocessor 15 also provides address information on address bus 39 and control signals on control lines 60 to memory control block 35. Memory control block 35 provides control signals to computer memory block 38 (VRAM and DRAM) on control lines 36, to data path block 31 on control lines 44 and to display 21 on control lines 61. The data path block 31 provides a path to or from RAM block 38 for both computer display data to/from data bus 40 and video data to/from pixel bus 32. Data, including mask data, is transferred on data bus 37 to/from the DRAM/VRAM block 38. Mask control lines 24 are provided from data path block 31 to memory control black 35.

Under control of the microprocessor 15 and memory control block 35, the data path block incorporates the video data on video bus 32 into the windowing system and windowing environment of the microprocessor itself or some other associated computer. The RAM memory block 38 includes a frame buffer (VRAM) that stores the information to be displayed on the display 21 and auxiliary memory (DRAM). RAM 38 receives addresses from memory control block 35 on RAM address bus 73. The RAM block 38 is coupled on display bus 42 to display 21. Video information can be displayed in one or more video windows such as video window 43 of display 21.

After video data 10 is converted to digital pixel values, it is provided on video bus 32 to data path 31 or compression block 33. Compression block 33 is used to compress the pixel stream for improved storage efficiency, if desired. Any of many well known compression schemes, such as JPEG, may be utilized. The compression block may receive video data at the same time as the data path block, allowing real-time video compression while viewing the incoming video data, the two processes operating independently.

Compressed video data is then provided to data path 31 on data bus 40. The compressed video data is manipulated in the data path 31 as for data front the microprocessor, and provided to memory 38 for eventual display or to data bus 40 for other manipulation (such as transfer to a mass-storage device, such as a disk).

The present invention may be used to generate video output data. The video output data may be original computer display data converted to video format. Alternatively, previously captured input video data may be converted back to video output data, either in its original format, or after it has been processed or modified. Digital pixel data is provided from DRAM and VRAM memory 38 to data path block 31. From there, it is routed to the encoder D/A block 34 on video bus 32. The encoder block 34 converts the digital pixel information to analog signals at a video rate to generate analog RGB signals. This analog RGB signal is then encoded into appropriate video format (NTSC or PAL) and provided as video output.

Video output data may also be in a compressed format. In this case, the MP provides data to compression block 33 for decompression on data bus 40. The decompressed video data is provided on video bus 32 to the encoder 34 for conversion to analog video output data and/or to RAM memory 38, via data path 31, for display in a video window.

Figure 7:
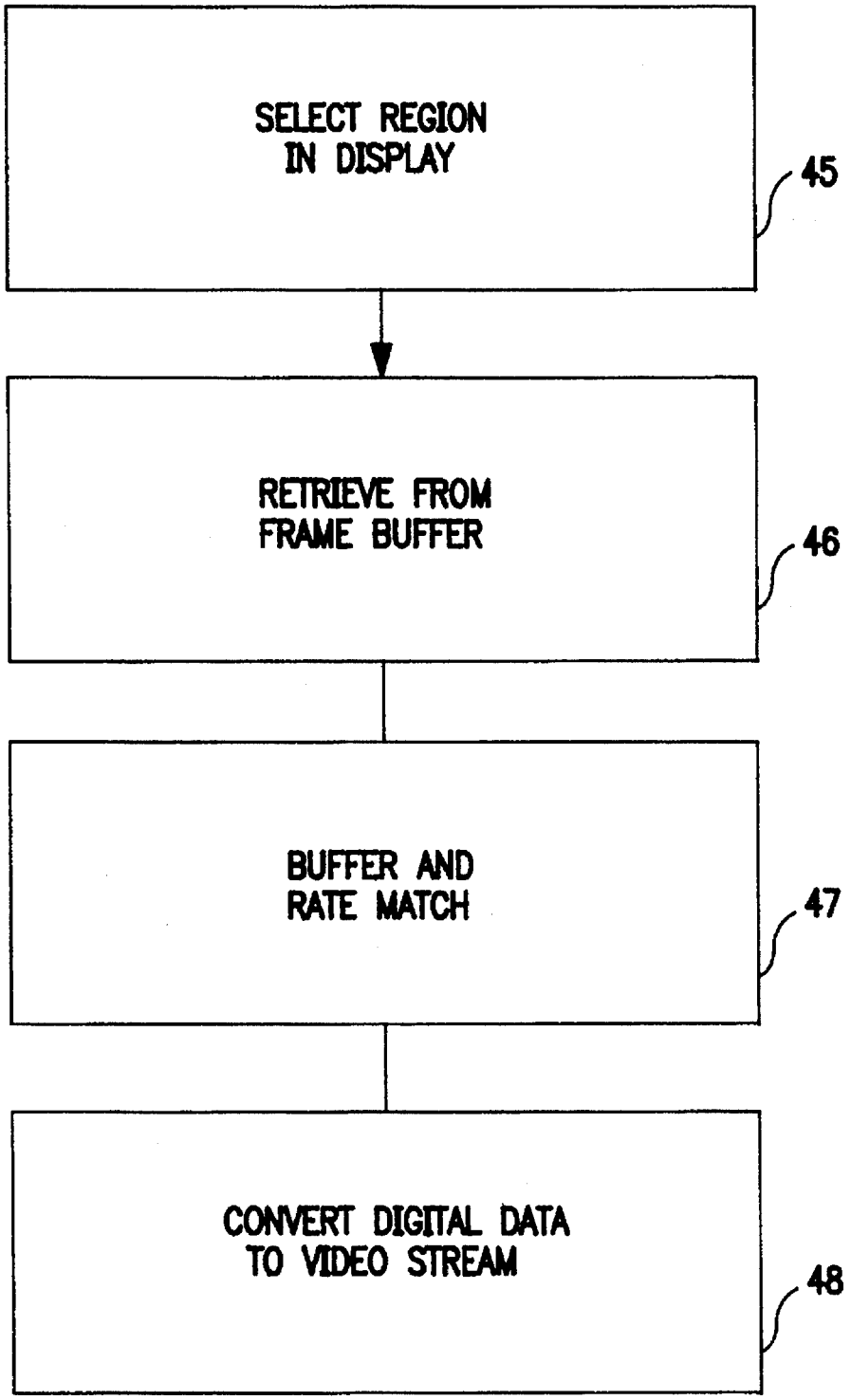
FIG. 7 is a flow diagram illustrating the generation of video output of the present invention.

A flow diagram illustrating the generation of video output using the present invention is illustrated in FIG. 7. At step 45, a region of the display to be converted to video output is selected. At step 46, the pixels corresponding to the selected region are retrieved from the frame buffer and provided to the data path block. In this embodiment, masking and resampling are not performed on the digital data used to generate video output. At step 47, the digital data is buffered to match the desired video output rate. At step 48, the selected digital data is converted from digital data to an analog video output stream.

The present invention can be used to extract information from the "vertical interval" of video frames. Video data is transmitted in video frames defined by, for example, the NTSC standard. Each video frame includes a region known as the "vertical interval" that may contain supplementary information. For example, the vertical interval can contain time code, TeleText, vertical interval test signals for calibration, and data provided by various services, such as UNIX mail, Closed-captioning information, etc.

In this invention, when video frames are received, visible video data can be provided to the computer display and the vertical interval information provided to a separate, perhaps non-visible, memory location. The vertical interval data can then be analyzed and used or displayed, if desired. In addition, for video output, vertical interval data can be generated and appended to video output fields, if desired.

MEMORY CONTROLLER

Figure 4:
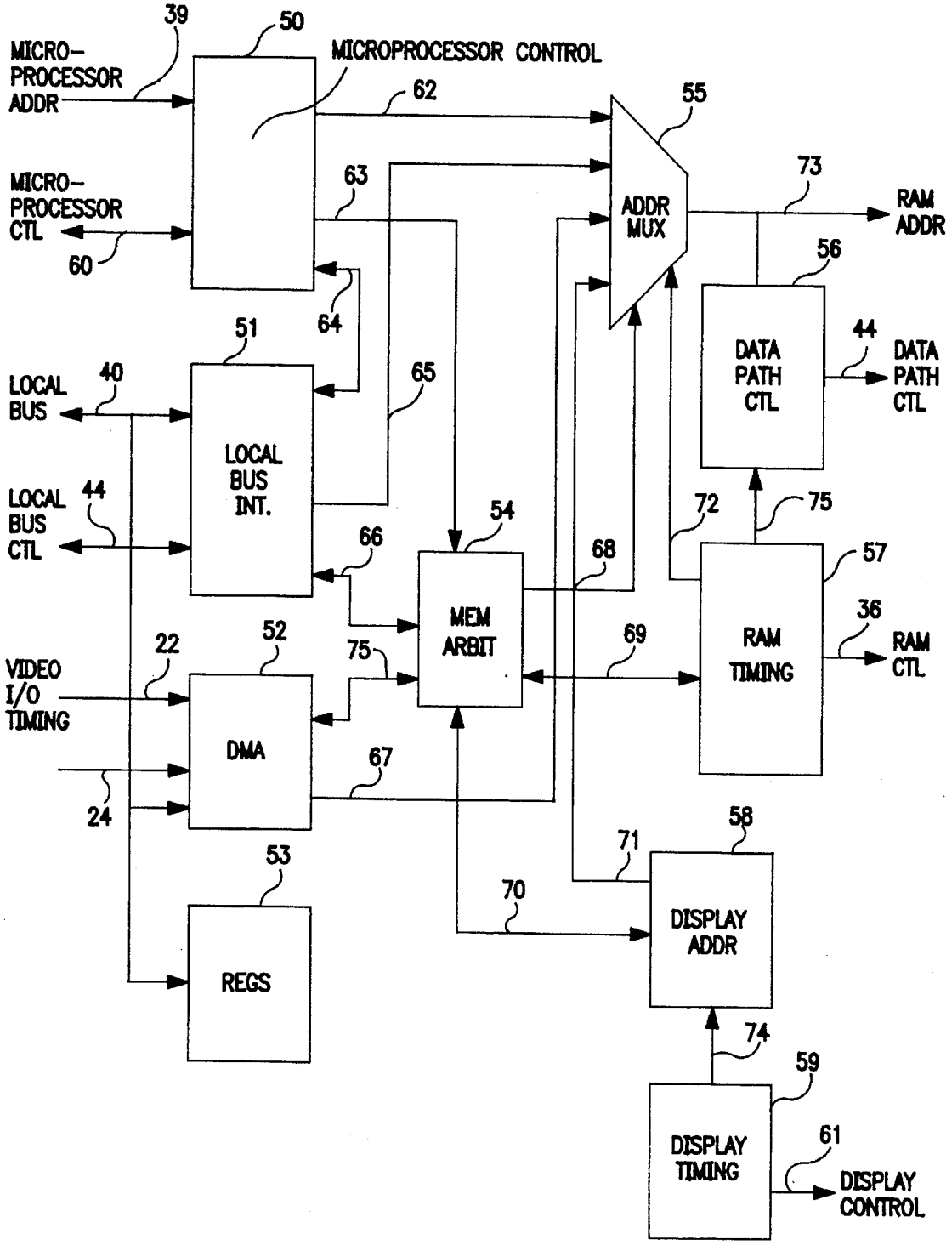
FIG. 4 is a detailed block diagram of the memory control block of FIG. 3.

A block diagram of the memory control block 35 is illustrated in FIG. 4. The memory controller generates system timing signals for this invention and provides control and timing for the memory block 38. The memory controller arbitrates requests for memory access from the microprocessor, video I/O, and display and memory refresh. The memory controller decodes the addresses for each access and initiates the proper sequence of control operations. The memory controller contains the video timing generator (for display video), and video direct memory access (DMA) controller.

The microprocessor 15 of FIG. 3 provides address information 39 and control lines 60 to microprocessor control block 50. The local bus interface 51 is coupled to the local bus 40, and provides local bus control signals on control lines 44. Local bus 40 is also connected to DMA block 52 and register block 53 The DMA block 52 receives video I/O timing on line 22 or 99 and provides video I/O control signals on control lines 44. The DMA block 52 also receives mask control line 24 from data path block 31 to enable the storage of valid pixels into RAM 38.

The microprocessor control block 50 provides lines 62 to address multiplexer 55. The microprocessor control block 50 also provides output 63 to memory arbitration block 54 and output 64 to local bus interface 51. The local bus interface provides output 65 to address multiplexer 55 and is coupled to memory arbitration block 54 through control lines 66. The DMA block 52 is coupled to the address multiplexer 55 on lines 67 and to memory arbitration block on control lines 75. The memory arbitration block 54 is coupled to the enable input of address multiplexer 55 through control lines 68. Memory arbitration block 54 is also coupled through control lines 69 to RAM timing block 57 and through control lines 70 to video address block 58. Display address block 58 provides addresses on control lines 71 to address multiplexer 55. Display timing block 59 provides display control output on control lines 61 and is coupled to display address block 58 on control lines 74. Address multiplexer 55 provides RAM address information 73 as output. RAM address 73 is also coupled to data path control block 56. Data path control block 56 provides data path control signals on control lines 44. RAM timing block 57 is coupled to data path control block 56 through control lines 75. RAM timing control block 57 provides RAM control signals on control lines 36.

The bus interface 51, DMA block 52, display address block 58 and microprocessor control block 50 generate request signals that are provided to the memory arbitration block 54 on control lines 66, 75, 70 and 63, respectively, to select the current RAM owner. The arbitration block 54 determines which requesting device, microprocessor, DMA block, local bus interface, video address block, etc., can access the RAM via address bus 73 and control bus 36. The memory arbitration block 54 provides control lines 68 which select one of the address inputs of the address MUX 55 so that the appropriate address is selected to drive RAM address bus 73. RAM timing block 57 is used to generate appropriate timing signals for the DRAM and VRAM block 38 (FIG. 3) and communicates with memory arbitration block 54 on control lines 69. If the address from MP control block 50 is not to a DRAM or VRAM address, a request is generated to the local bus unit in the memory controller on control lines 64. The local bus interface unit generates a transaction over the local bus or to memory control register block 53. Register block 53 in the memory controller is mapped into the local bus memory space.

A microprocessor control block 50 provides an interface between the microprocessor 15 (see FIG. 3) and the RAM 38. A number of devices, such as the video decoder, compression block, microprocessor, etc., arbitrate through the memory controller for access to the RAM 38 via the datapath 31. When the microprocessor 15 is given access to the RAM, the microprocessor control block 50 interfaces the timing signals of the microprocessor for appropriate operation. The local bus interface 51 provides an interface to the local bus 40 and is used to interface the microprocessor to devices other than the RAM. The local bus is a subset of data bus 40 (FIG. 3).

The DMA block 52 generates the addresses for video input/output and receives horizontal and vertical information from the video decoder 11 (FIG. 3) or compression block 33. The memory controller can control DMA input or output of video in a number of configurations and directions (see FIGS. 6A–6E). Registers 53 act as control registers for the memory controller and are programmed by the microprocessor 15.

DATA PATH

Figure 5:
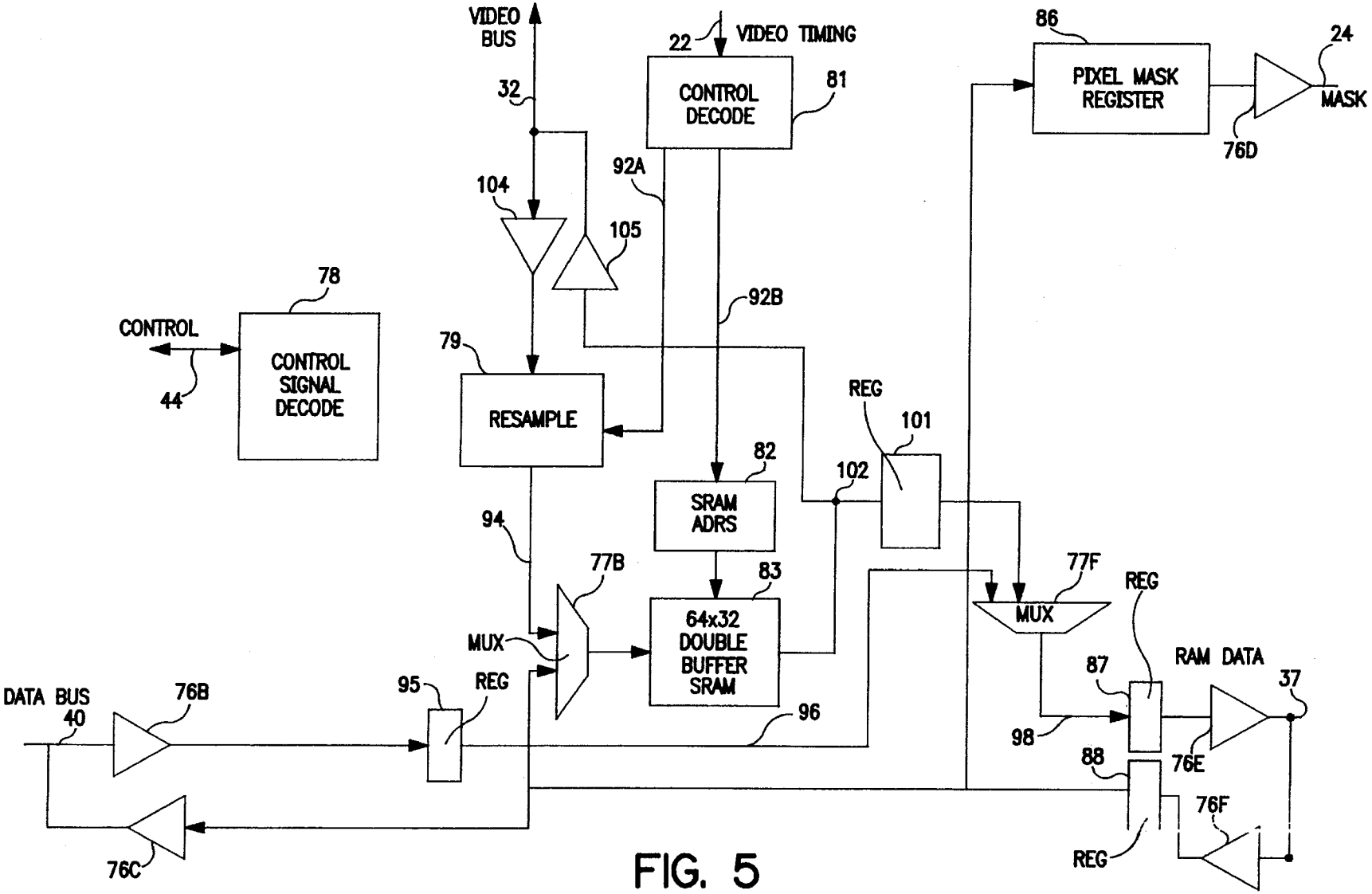
FIG. 5 is a detailed block diagram of the data path block of FIG. 3.

A block diagram of the data path block 31 is illustrated in FIG. 5. Video timing is provided to control decode block 81. Digitized video data is coupled to the data path block 31 on video bus 32 and is provided through buffer 104 to resampling block 79. As noted previously, the resample block 79 utilizes edge tables to filter the video input data to a desired array. Control decode block 81 provides control lines 92A to resample block 79. The output 94 of resample block 79 is coupled through multiplexer 77B to buffer 83.

Buffer 83 is a 64×32 double buffer static RAM (SRAM) and is used to rate match the video input data to the data rate of the computer bus. The control decode block 81 provides control lines 92B to static RAM address block 82. Static RAM address block 82 provides address information to buffer 83. Control lines 44 are provided to control signal decode block 78.

The data bus 40 is coupled through buffer 76B to register 95. The output 96 of register 95 is coupled to one input of multiplexer 77F. The other input of multiplexer 77F is coupled from register 101 which is coupled from the output 102 of buffer 83. Output 102 is also coupled through buffer 105 to video bus 32. Video bus 32 is a tri-state bus in the preferred embodiment of this invention. The output 98 of multiplexer 77F is coupled to register 87. The output of register 87 is coupled through buffer 76E to RAM data bus 37. RAM bus 37 is coupled to the DRAM frame buffer memory 38 (FIG. 3). Multiplexer 77F allows either pixel data or data from data bus 40 to be provided to the DRAM 38. RAM data bus 37 is also coupled through buffer 76F to register 88.

The output of register 88 is coupled to one input of multiplexer 77B. The output of multiplexer 77B is coupled to double buffer 83. Multiplexer 77B allows the buffer 83 to be used for either input of video data or output of video data. The output of register 88 is also coupled to pixel mask register 86. The output of pixel mask register 86 is coupled to buffer 76D. The output of buffer 76D is the mask control lines 24. The output of register 88 is also coupled through buffer 76C to the databus 40.

The control signal decode block 78 decodes control signals from the memory control block on control lines 44. The control decode block 81 is used to decode control signals from the decoder block 11. Pixel data is provided to resample block 79 for resizing, if desired, and then to double buffer SRAM 83 for rate matching. The output of the buffer 83 is provided as output on DRAM bus 37.

Masking is provided by pixel mask register 86 to identify the valid pixels. The mask register is loaded via RAM data bus 37 under control of memory controller 35. As video pixels are outputted on RAM data bus 37, a check of the mask register is made. If the corresponding location in the mask register is a "1", that pixel is written to RAM. If the mask register location is "0", the pixel is not written to RAM. The 64-bit mask register is loaded before each 64-pixel data block transfer.

Figure 6A:
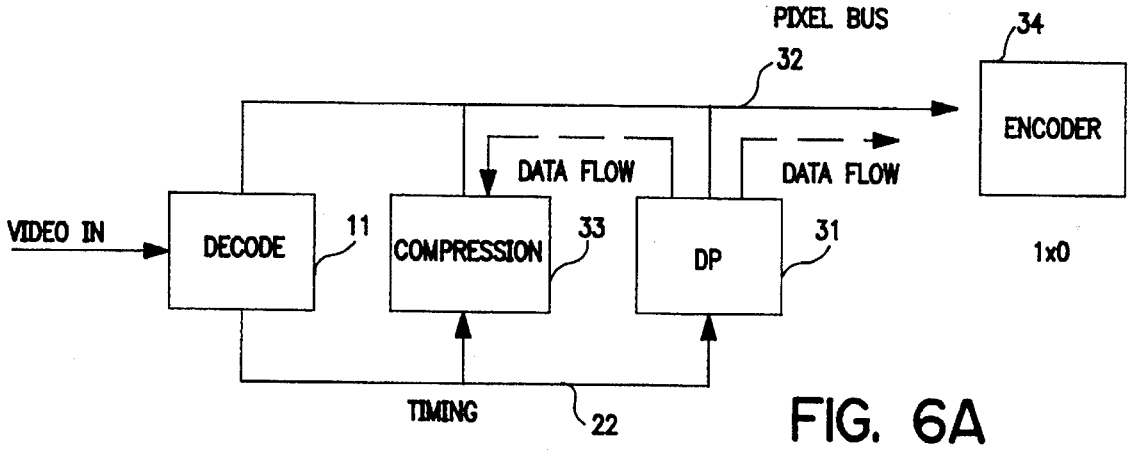
FIGS. 6A–6E are block diagrams illustrating data flow and timing control configuration of this invention.

FIGS. 6A–6E illustrate data flow and timing configuration possibilities in the present invention. In each of the figures, video input is provided to the decode block 11 and video bus 32 couples decode block 11 with compression block 33 and data path block 31. In FIG. 6A, the pixel timing 22 from the decode block 11 controls compression block 33 and data path block 31. Data flows from data path block 31 to the compression block 33 and to video encoder 34.

Figure 6B:
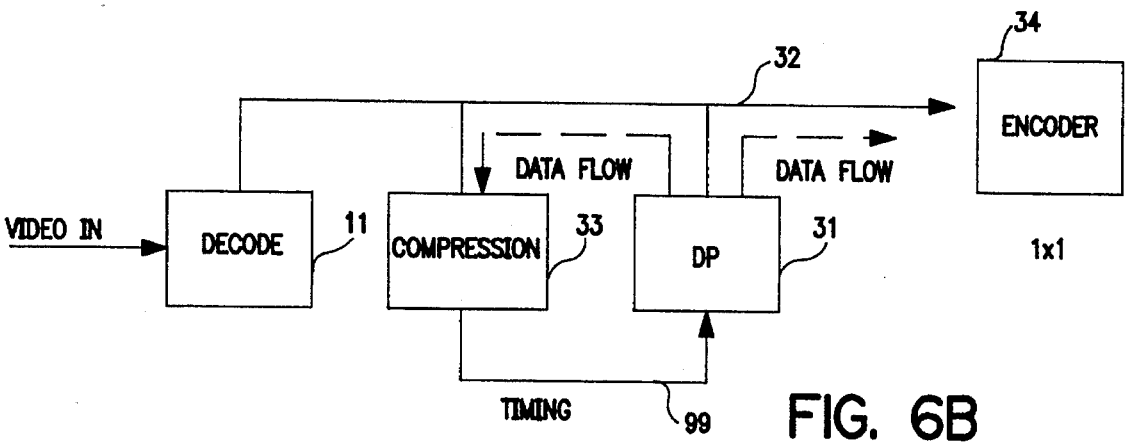
Figure 6C:
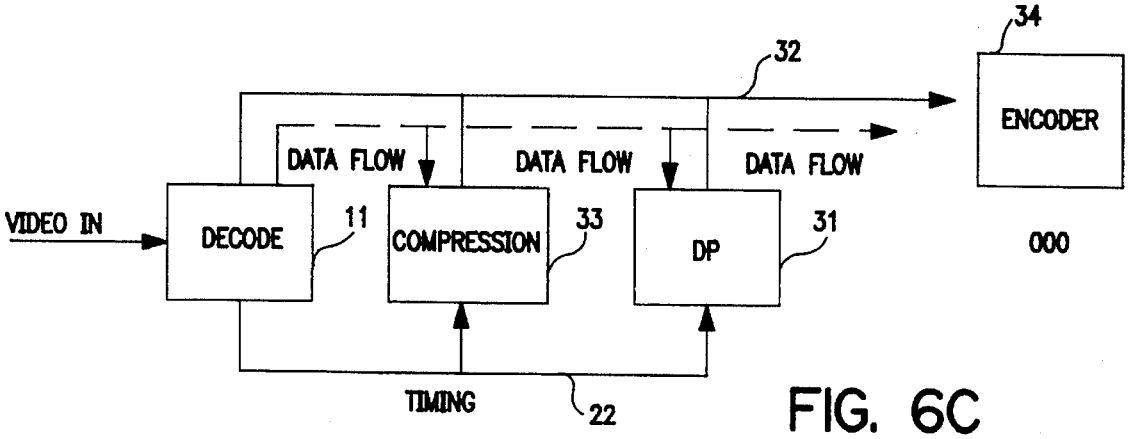

In FIG. 6B, timing 99 is provided from the compression block 33 to the data path block 31 and data flows from the data path block 31 to the compression block 33 and to video encoder 34. In FIG. 6C, pixel timing 22 is provided from the decode block 11 to the compression block 33 and data path 31 and data flows from the decode block 11 to the compression block 33, data path block 31 and video encoder 34.

Figure 6D:
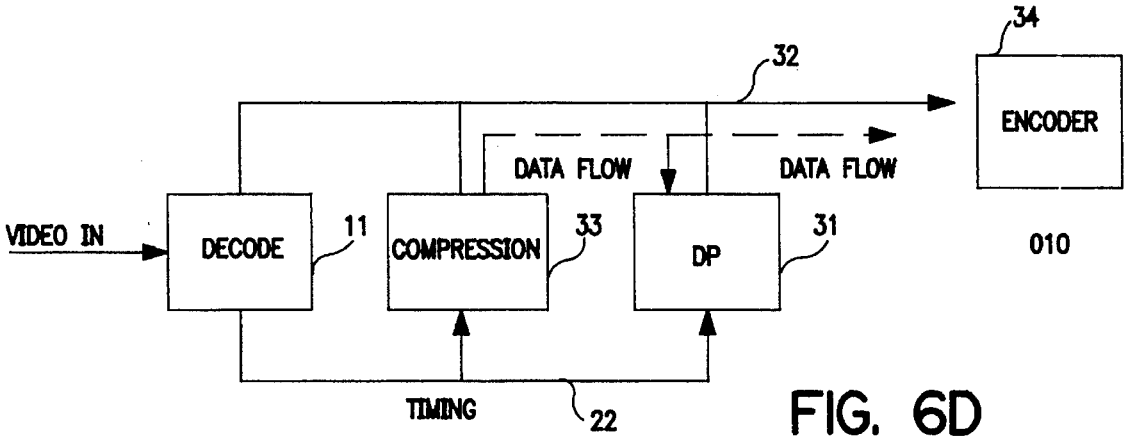
Figure 6E:
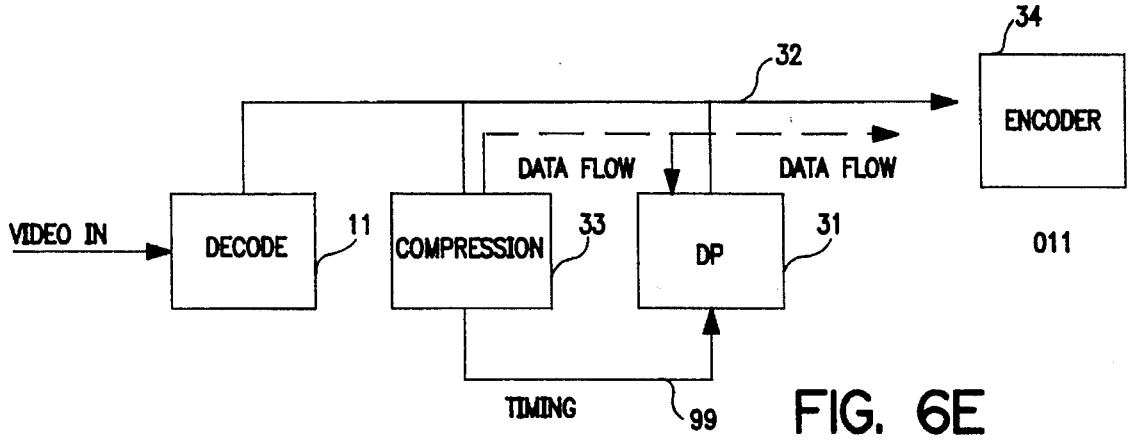

Alternatively, as shown in FIGS. 6D and 6E, data flow can be from the compression block 33 to the data path block 31 and to video encoder 34. In FIG. 6D, timing is from the decode block 11 and is provided to compression block 33 and data path block 31. In FIG. 6E, timing 99 is provided from the compression block 33 to the data path block 31.

Thus, a method and apparatus for displaying video information as part of a windowing environment has been described.

We claim:

1. A method of displaying analog video data and computer display data comprising text and graphics on a computer display comprising the steps of:

providing analog video data to a converting means and converting said analog video data to a digital pixel stream;

buffering said pixel stream and converting said pixel stream to a plurality of pixel packets;

determining valid pixels of said pixel packets, said step of determining valid pixels accomplished by providing a bit mask having a number of bits, each corresponding to a pixel within a window of a multi-window system in a computer memory, assigning a first bit value for valid pixel display locations and a second bit value for invalid pixel display locations, and conditionally writing each pixel of said pixel packet to a destination location in said computer memory dependent on a corresponding bit location in said bit mask;

storing said valid pixels of a window in a multi-window system in a computer memory at a first rate, said computer memory also storing said computer display data at a second rate; and, providing said valid pixels from said computer memory for display on said computer display.

2. The method of claim 1 wherein said step of converting said analog video data to a digital pixel stream comprises the steps of:

determining chrominance and luminance values for said analog video data;

converting said chrominance and luminance values to digital chrominance and luminance values;

converting said digital chrominance and luminance values to digital red-green-blue (RGB) values.

3. The method of claim 1 further including the steps of:

determining an array size A×B of said digital pixel stream; and providing said digital pixel stream to a resampling means to convert said A×B array to an N×M array where $N \leqq A$ and $M \leqq B$.

4. The method of claim 1 wherein said step of buffering said pixel data stream comprises the steps of:

writing said pixel data stream into a first of a pair of buffer memories;

reading a pixel packet from said first memory and writing said pixel data stream into a second of said pair of buffer memories;

reading a pixel packet from said second buffer and writing said pixel data stream into said first of said pair of buffer memories; and, repeating the previous two steps.

5. An apparatus for displaying video data and computer display data on a computer display comprising:

converting means for receiving an analog video signal and for converting said analog video signal to a digital pixel stream;

buffering means coupled to said converting means for receiving said digital pixel stream and converting said digital pixel stream to a plurality of pixel packets;

control means coupled to said buffering means for determining valid pixels of said pixel packet and for providing said valid pixels and said computer display data as output; and, a computer memory of said computer display coupled to said control means for storing said valid pixels of a window in multi-windows on the computer display at a first rate and for providing said valid pixels to said computer display, said computer memory also storing said computer display data at a second rate; and a bit mask located in said computer memory and referenced by said buffering means, said bit mask having a number of bits, each corresponding to a pixel display location of an associated display window, each of said bits having a first bit value when a destination display location of a pixel packet is invalid and a second bit value when a destination display location of a pixel of a pixel packet is valid.

6. The apparatus of claim 5 wherein said converting means comprises:

digital to analog converting means for converting said analog video data to digital chrominance and luminance values; and, matrix multiplying means for converting said digital chrominance and luminance values to digital red-green-blue (RGB) pixel values.

7. The apparatus of claim 5 further including resampling means for converting an A×B array of said digital pixel stream to an N×M array where N≦A and M≦B.

8. The apparatus of claim 6 wherein said buffering means comprises a pair of buffer memories and one of said pair of memories is written with said digital pixel stream while a pixel packet is read from the other of said pair of memories.

9. A method of displaying video data and computer display data comprising text on a computer display comprising the steps of:

providing analog video data to a converting means at a first rate;

converting said analog video data to a digital pixel stream;

buffering said pixel stream and converting said pixel stream to a plurality of pixel packets;

determining valid pixels of said pixel packets, said step of determining valid pixels being accomplished by referencing a bit mask located in a computer memory and having a number of bits, each corresponding to a pixel location of an associated display window of a plurality of display windows on the computer display, assigning a first bit value for valid pixel display locations and a second bit value for invalid pixel display locations, and conditionally writing each pixel of said pixel packet to a destination location in said computer memory dependent on a corresponding bit location in said bit mask;

storing said valid pixels of a window in a multi-window system in a computer memory of said computer display at the first rate, said computer memory also storing said computer display data at a second rate; and providing said valid pixels from said computer memory to said computer display at the second rate for display on said computer display.

10. The method of claim 9 wherein said second rate is higher than said first rate.

11. The method of claim 9 wherein said step of converting said analog video data to a digital pixel stream comprises the steps of:

determining chrominance and luminance values for said analog video data;

converting said chrominance and luminance values to digital chrominance and luminance values;

converting said digital chrominance and luminance values to digital red-green-blue (RGB) values.

12. The method of claim 9 further including the steps of:

determining an array size of A×B of said digital pixel stream; and, providing said digital pixel stream to a resampling means to convert said A×B array to an N×M array where N≦A and M≦B.

13. The method of claim 9 wherein said step of buffering said pixel data stream comprises the steps of:

writing said pixel data stream into a first of a pair of buffer memories;

reading a pixel packet from said first memory and writing said pixel data stream into a second of said pair of buffer memories;

reading a pixel packet from said second buffer and writing said pixel data stream into said first of said pair of buffer memories; and, repeating the previous two steps.

14. An apparatus for displaying video data and computer display data comprising text and graphics on a computer display comprising:

converting means for receiving an analog video signal at a first rate and for converting said analog video signal to a digital pixel stream;

buffering means coupled to said converting means for receiving said digital pixel stream and converting said digital pixel stream to a plurality of pixel packets;

control means coupled to said buffering means for determining valid pixels of said pixel packet and for providing said valid pixels and said computer display data as output; and, a computer memory of said computer display coupled to said control means for storing said valid pixels of a window in multi-windows on said computer display and for providing said valid pixels at second rate to said computer display, said computer memory also storing said computer display data at a third rate; and, a bit mask located in said computer memory and referenced by said buffering means, said bit mask having a number of bits, each corresponding to a pixel display location in a display window, each of said bits having a first bit value when a destination display location of a pixel packet is invalid and a second bit value when a destination display location of a pixel is valid.

15. The apparatus of claim 14 wherein said second rate is higher than said first rate.

16. The apparatus of claim 14 wherein said converting means comprises:

digital to analog converting means for converting said analog video data to digital chrominance and luminance values; and, matrix multiplying means for converting said digital chrominance and luminance values to digital red-green-blue (RGB) pixel values.

17. The apparatus of claim 14 further including resampling means for converting an A×B of said digital pixel stream to an N×M array where N≦A and M≦B.

18. The apparatus of claim 14 wherein said buffering means comprises a pair of buffer memories and one of said pair of memories is written with said digital pixel stream while a pixel packet is read from the other of said pair of memories.

19. The apparatus of claim 14 further including means for generating computer display data, said computer display data stored in said computer memory with said pixel data.

20. A method for displaying video data generated from an analog source mixed together in a windowing display system with non-video data generated by a computer, said method comprising the steps of:

storing the non-video data in a video memory, each location of the video main memory being provided in correspondence with a pixel on a display monitor, wherein the non-video data is stored in at least one first window;

defining in a bitmask for at least one second window for the video data, wherein bits in the bitmask are selectively set ON in a case where the bit lies within the second window and OFF in a case where the bit lies outside the second window or in a case where the bit is overlapped by any of said at least one first window;

providing analog video data to an A/D converting means and converting said analog video data to a digital pixel stream;

buffering said digital pixel stream and converting said digital pixel stream to a plurality of pixel packets at a first rate;

writing selected ones of pixels from the plurality of pixel packets to the video memory, pixels being selected for writing to the video memory in accordance with whether a corresponding bit in the bitmask is ON; and reading data, comprising both non-video data in the first window and video data in the second window, from the video memory to the display monitor, wherein reading from the video memory is at a second rate which is higher than the first rate.

* * * * *

UNITED STATES PATENT AND TRADEMARK OFFICE

CERTIFICATE OF CORRECTION

PATENT NO. : 5,557,302

DATED : September 17, 1996

INVENTORS : Adam Levinthal, et al.

It is certified that error appears in the above-identified patent and that said Letters Patent is hereby corrected as shown below:

COLUMN 1

Line 6, "08/004,637" should read --08/272,908, July 8, 1994, which was a continuation of Serial No. 08/004,637.--

COLUMN 6

Line 29, "front" should read --from--.

COLUMN 11

Line 10, "claim 6" should read --claim 5--.

Signed and Sealed this

Fourth Day of March, 1997

Bruce Lehman

*Attest:*

BRUCE LEHMAN

*Attesting Officer*

*Commissioner of Patents and Trademarks*